US006644220B2

(12) United States Patent
Gangloff et al.

(10) Patent No.: US 6,644,220 B2
(45) Date of Patent: Nov. 11, 2003

(54) METAL PALLET FOR LARGE VOLUME CONTAINERS

(75) Inventors: Robert Gangloff, Bettwiller (FR); Francis Hermann, Trois Maisons (FR); Emile Holzscherer, Weyer (FR); Thierry Ohresser, Sarrebourg (FR); Thierry Weissgerber, Saverne (FR)

(73) Assignee: Sotralentz S.A., Drulingen (FR)

( * ) Notice: Subject to any disclaimer, the term of this patent is extended or adjusted under 35 U.S.C. 154(b) by 0 days.

(21) Appl. No.: 09/975,644

(22) Filed: Oct. 11, 2001

(65) Prior Publication Data

US 2002/0078558 A1 Jun. 27, 2002

(30) Foreign Application Priority Data

Oct. 13, 2000 (DE) ..... 100 50 920

(51) Int. Cl.[7] ..... B65D 19/38
(52) U.S. Cl. ..... 108/57.32; 108/55.1; 108/24
(58) Field of Search ..... 108/57.32, 57.3, 108/51.1, 57.6, 53.1, 53.3, 53.5, 57.13, 24, 55.3

(56) References Cited

U.S. PATENT DOCUMENTS 2,615,661 A * 10/1952 Cushman
3,120,825 A * 2/1964 Johnson
3,228,358 A * 1/1966 Sepe et al.
3,433,184 A * 3/1969 Addy
3,526,195 A * 9/1970 Maryonovich
3,611,952 A * 10/1971 Hoffman
3,776,435 A * 12/1973 Smith
4,326,467 A * 4/1982 Schleicher et al.
4,674,414 A * 6/1987 Nulle et al.
5,722,328 A * 3/1998 Darby
6,446,563 B1 * 9/2002 Ohanesian

FOREIGN PATENT DOCUMENTS

| | | |
|---|---|---|
| DE | 43 18 966 | 12/1994 |
| EP | 0 989 071 | 3/2000 |
| WO | WO 00/78620 A1 * | 12/2000 |

* cited by examiner

*Primary Examiner*—Jose V. Chen
(74) *Attorney, Agent, or Firm*—Collard & Roe, P.C.

(57) ABSTRACT

A metal pallet for securing the container that has pallet feet arranged in the corner areas. The metal pallet and the pallet feet are realized in the form of one single structural unit. The pallet feet are connected with each other via a stiffening frame. Furthermore, a stiffening traverse member is arranged on the bottom of the metal pallet and connected with the bottom of the metal pallet and lateral support feet in a form- and force-locked manner.

19 Claims, 5 Drawing Sheets

FIG. 4
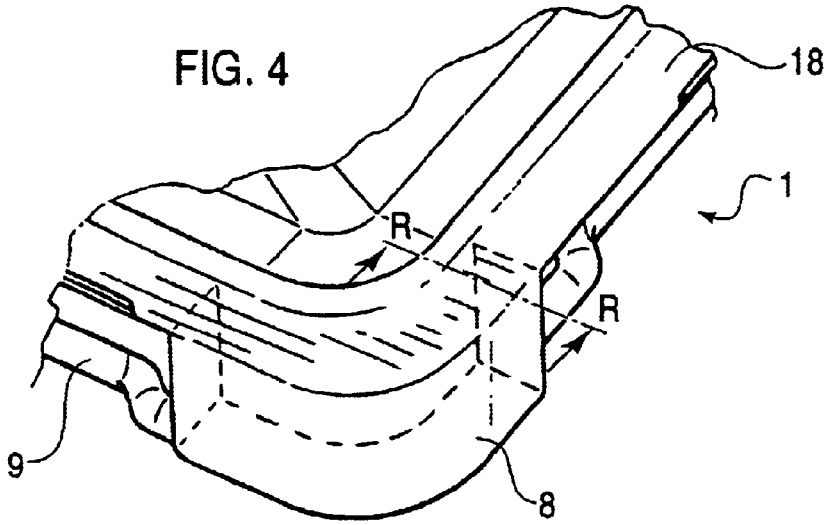
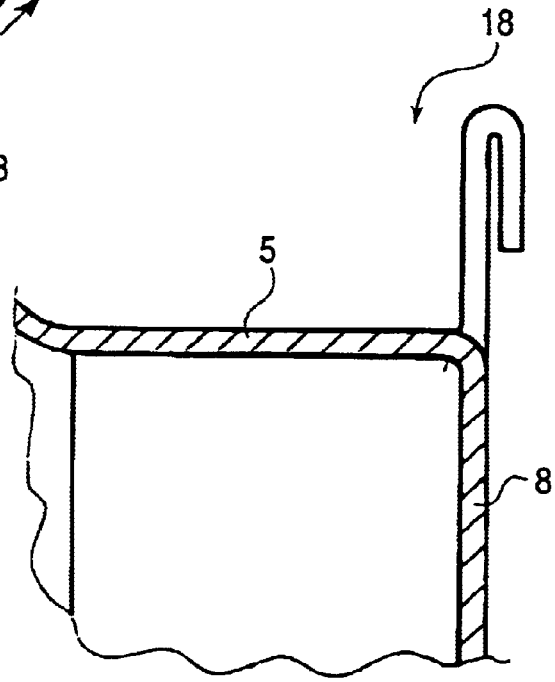
FIG. 5
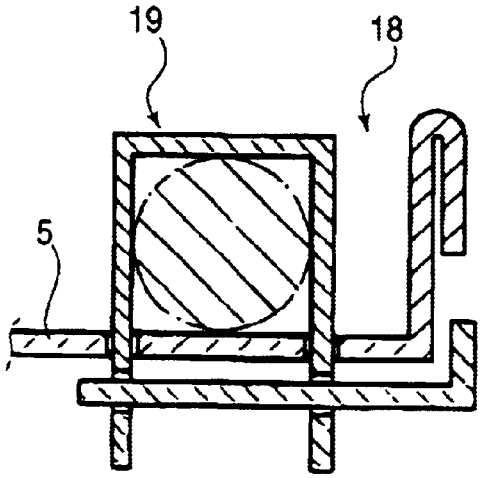
FIG. 8

METAL PALLET FOR LARGE VOLUME CONTAINERS

BACKGROUND OF THE INVENTION

1. Field of the Invention

The invention relates to a metal pallet for containers, in particular large-volume containers. The metal pallet has a pallet top and pallet bottom for placing and securing a container on it. This metal pallet has stiffening formations, a molded-in support foot on the front side for receiving a draining device, and pallet feet in the corner areas connected to each other via a stiffening frame. Within the framework of the invention, containers are understood to be plastic containers for liquids and flowable products. These containers are surrounded by a jacket made of wire grating having regular horizontal and vertical lattice bars, as well as a filling and a draining opening. The plastic containers enclosed by the wire-grating jacket may have a holding capacity of 1000 liters or more.

2. Prior Art

Various types of metal pallets for containers are known. These metal pallets are designed for being handled by forklift trucks, shelf-serving devices or the like. They are provided with a bottom trough that receives the plastic container in a form-locked manner and also attaches the lattice jacket. The bottom of the pallet may have a draining gutter that extends with a slight gradient from the back wall of the container to the short draining pipe arranged on the front wall of the container. This draining pipe may be connected to a draining valve.

The bottom of the pallet may comprise stiffening formations and has an outer support edge that is drawn downwards. The bottom trough of the pallet is connected to the flat sub-frame making a hollow-chamber bottom with open chambers and an outer hollow support collar extending all around. The bottom trough is a deep-drawn component made of metal sheet comprising a center foot with a profile having a U-shaped cross section. The center foot is molded below the draining valve of the plastic container and is open in front and in the upward direction.

Furthermore, an angled edge strip may be made to form a sub-frame jointly with stiffening struts secured below the bottom trough (see DE 43 18 966). The known embodiment is structured from a multitude of individual components and therefore relatively complicated in terms of manufacturing and assembly techniques. For example, the feet of the pallet, as separate structural components, have to be screwed to a pallet frame designed in the form of a steel tube frame.

The feet of the pallet are designed as separate structural components and may also be attached by welding between the bottom of the pallet and the stiffening frame (see EP 0 989 071).

The known metal pallets are frequently unsatisfactory due to their instability. The storage containers comprised of the metal pallet and the container are subjected to stress such as shock or impact when crashing down from a loading ramp or falling off a hoisting gear. They may also be subject to vibration stress during transport. Therefore, permanent strength and a long useful life are demanded, particularly for metal pallets as well. Such requirements are generally not satisfied if the metal pallets are structured from a multitude of individual components. The invention is intended to provide a remedy in this regard.

SUMMARY OF THE INVENTION

The invention provides a metal pallet for containers, especially for large-volume containers of the type described above characterized by a particularly simple and stable type of construction. This stability assists regarding stresses caused by crashing, impacts and vibrations, and consequently establishes high permanent strength and a long useful life.

The bottom and the feet of the pallet are designed in the form of a one-piece structural component. The bottom of the pallet comprising the stiffening formations, the molded-in support foot and the molded-on pallet feet are produced from a pre-cut metal plate. This metal plate may be a steel sheet plate in the course of a drawing/reshaping process, such as a deep-drawing process and a reshaping bending operation.

The invention is based on the finding that a metal pallet can be produced in a simple manner in the form of a one-piece structural component with molded-on pallet feet, in a manner such that increased permanent strength and a longer useful life are obtained. In particular, the crash and impact stresses that must be regularly absorbed are more easily handled due to a substantial damping effect resulting from the molded-on feet of the pallet. Vibration stress is flawlessly absorbed as well because the feet and the bottom of the pallet form one single structural component. Increased manipulation, transport and accident safety are consequently achieved.

The feet of the pallet are produced from the metal attachments by bending the latter off and over, and the feet extend under the bottom of the pallet in order to obtain an optimal damping effect. This can be successfully accomplished particularly if the edges of the feet are joined with the pallet bottom by welding, clamping, or are secured on the pallet bottom in some other way. An additional support foot can be molded-in in the back of the metal pallet, or molded on from a metal attachment in the course of a reshaping bending process.

The stability of the metal pallet is increased further in that a drainage gutter is molded into the metal pallet, extending from the support foot in the back to the support foot located on the front with a predetermined inclination. This also assures flawless drainage of rain water between the container and the metal pallet.

To further increase the stability, permanent strength, and useful life of the metal pallet as defined by the invention, a stiffening traverse member is arranged on the pallet bottom. The stiffening traverse member extends in an orthogonal manner in relation to the drainage gutter from the one broad side to the other broad side of the bottom of the pallet. It comprises support feet on its ends, or it is connected to the support feet of the metal pallet. The stiffening traverse member is designed in the form of a multi-gutter section in which the cross section comprises a meander-like profile or alternating U-profiles. The pallet bottom comprises U-shaped molded recesses that engage the U-profiles of the stiffening traverse member, joining the pallet bottom in a form- and force-locked or positive manner. Furthermore, the stiffening traverse member with the support feet may be connected with the pallet bottom in the area of the support feet by welding, clamping, or in some other manner. According to another embodiment, it is possible also to weld-in or clamp-in the stiffening traverse member between the support feet and the pallet bottom, or to secure it there in some other way.

As a result, the metal pallet as-defined by the invention is comprised of only three individual components; the metal pallet with the molded-on pallet feet, the stiffening traverse member and the stiffening frame. Such minimization of the individual components optimizes the permanent strength and the useful life of the metal pallet as defined by the invention.

The stiffening beads or formations, which form depressions in the metal pallet are rectangles, squares or circles. The rectangles, squares or circles are preferably distributed across the surface area of the metal pallet in an axially symmetrical or mirror-symmetrical arrangement and may comprise diagonal or radial beads. The stiffening traverse member is usefully centered between the associated flanks of the rectangle or square formations bulging outwards from the pallet bottom.

The bottom of the pallet may comprise a dish-like receptacle for receiving the container with adaptation to the bottom of the container. To the extent that the container is substantially comprised of a plastic container with a wire grating jacket surrounding the plastic container, the bottom of the pallet comprises a installation groove for connecting the wire grating jacket on the peripheral side. The connection can be produced in the course of the process in which the wire lattice jacket is welded, clipped or screwed on.

Between the feet of the metal pallet and the support feet, the pallet bottom with the stiffening frame comprises slide-in openings that may be engaged by forklift trucks or similar hoisting gear. According to a preferred embodiment of the invention, the stiffening frame is recessed between the feet of the pallet and the support feet to the pallet bottom in order to further increase the stability of the metal pallet in the course of manipulation with a fork-lift truck and hoisting gear for large scale construction.

BRIEF DESCRIPTION OF THE DRAWINGS

Other objects and features of the present invention will become apparent from the following detailed description considered in connection with the following drawings. It is to be understood, however, that the drawings are designed for the purpose of illustration only and not as a definition of the limits of the invention.

In the drawings, wherein similar reference characters denote similar elements throughout the several views:

FIG. 4 shows an enlarged cutout from the object according to FIG. 2 in the area of the pallet foot.

FIG. 5 is a vertical section A—A through the object according to FIG. 4.

FIG. 8 is a vertical section D—D through the object according to FIG. 1, with a clip fastening for securing the wire-grating jacket.

DETAILED DESCRIPTION OF THE PREFERRED EMBODIMENT

Figure 1:
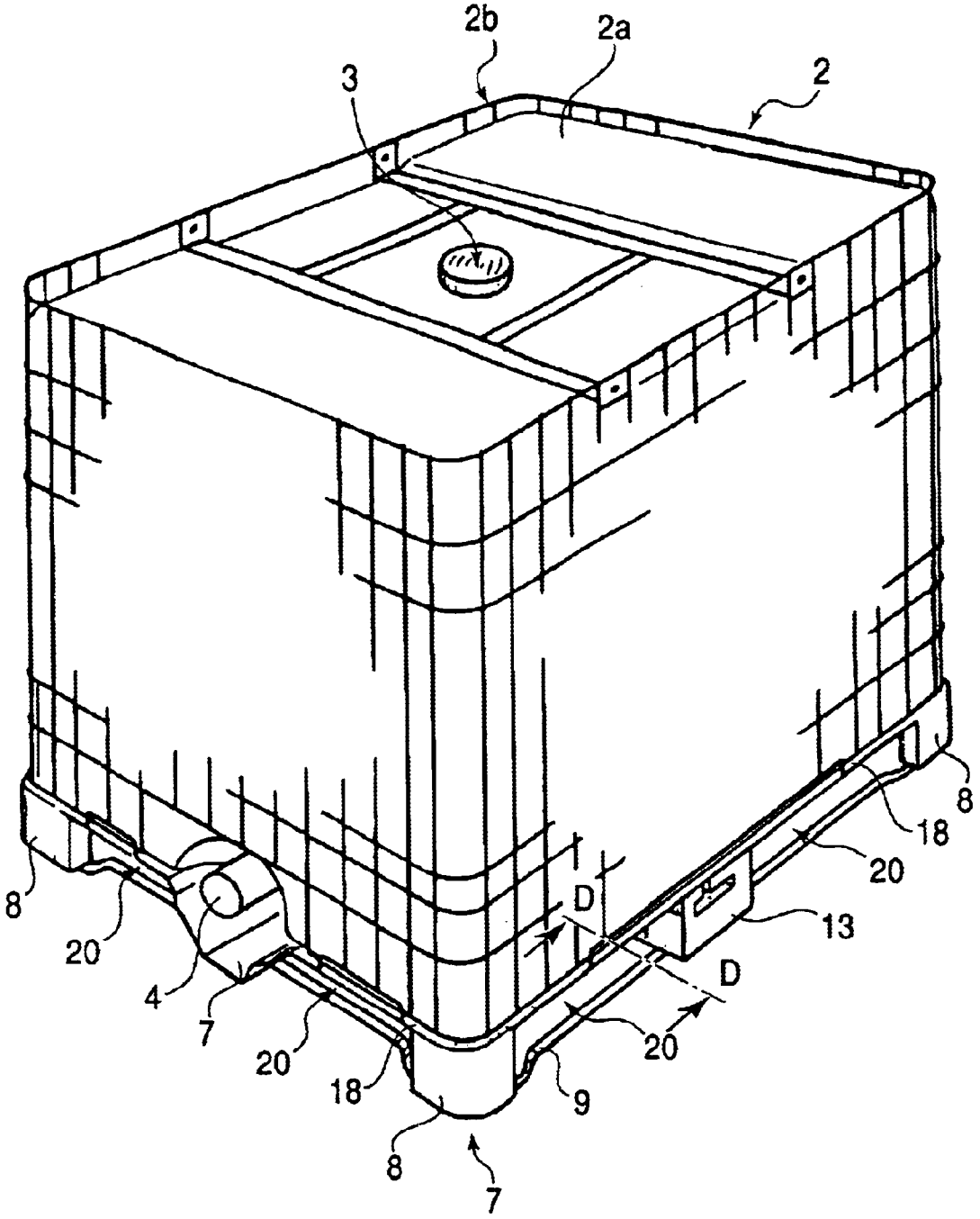
FIG. 1 is a perspective view of a transport and/or storage container comprising a metal pallet as defined by the invention and a container.
Figure 2:
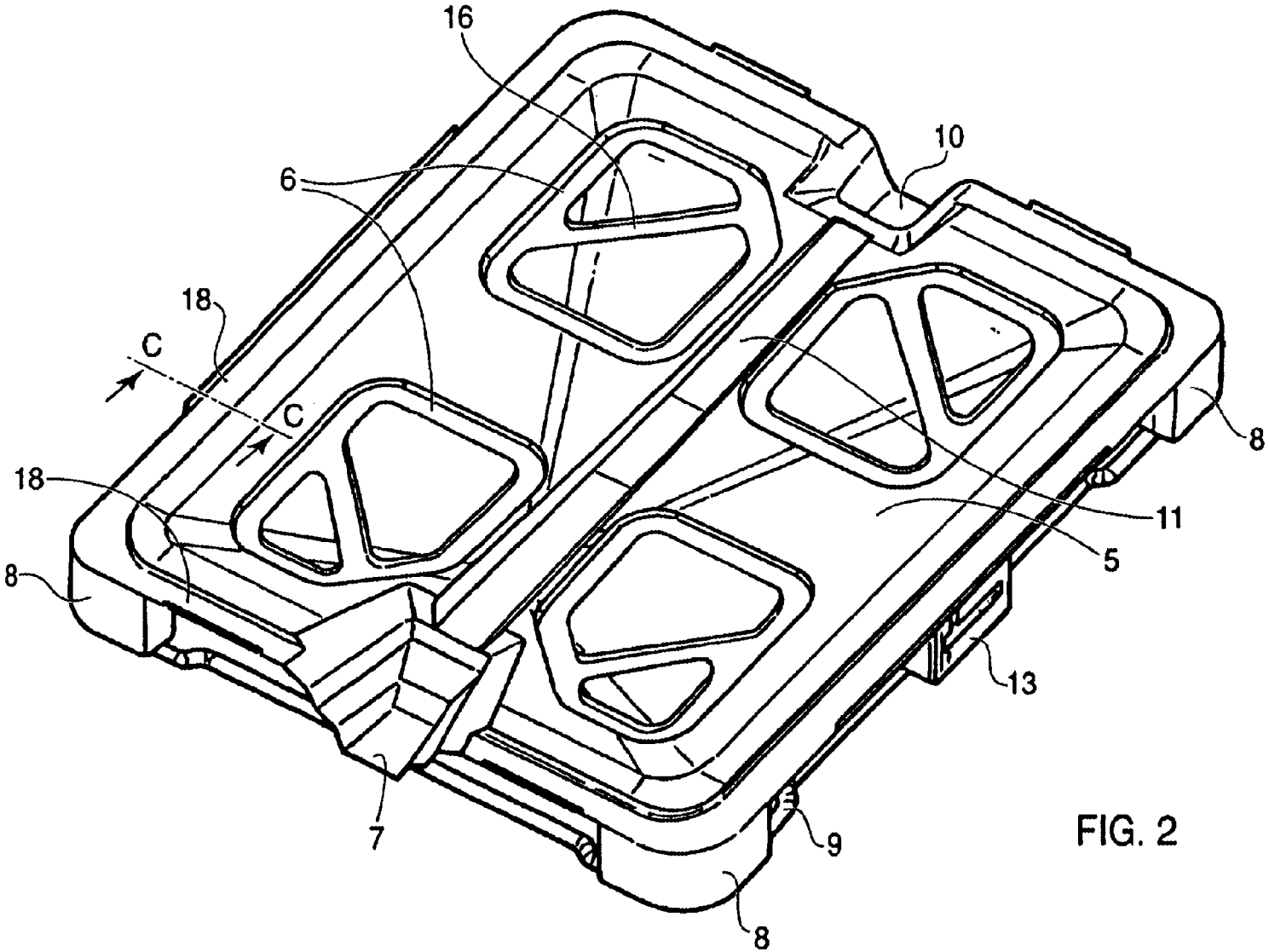
FIG. 2 is a top and perspective view of the metal pallet as defined by the invention.
Figure 3:
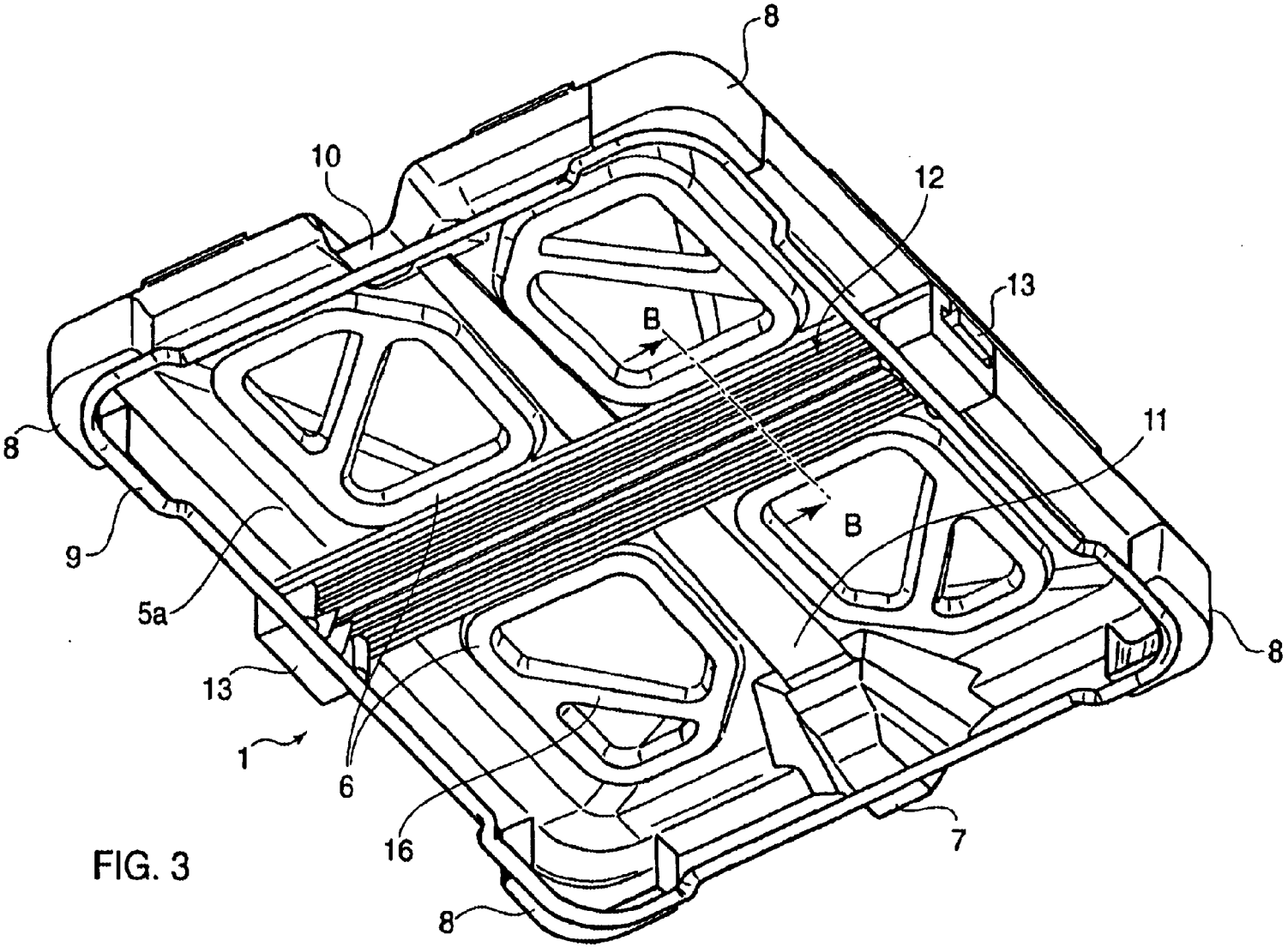
FIG. 3 is a bottom and perspective view of the metal pallet as defined by the invention.

Turning now in detail to the figures, FIGS. 1–3 show a metal pallet 1 for a container 2. Container 2 is a plastic container 2*a* with a wire grating jacket 2*b* made of horizontal and vertical grating bars, and comprising filling opening 3 and short drain pipe 4. Metal pallet 1 comprises a pallet top 5 and a pallet bottom 5*a* for receiving and securing container 2 or plastic container 2*a*. Metal pallet 1 at least comprises stiffening formations 6, molded-in support foot 7 located on the front side for receiving a draining device for emptying plastic container 2*a*, and pallet feet 8 arranged in the corner areas. Pallet feet 8 are connected with each other via stiffening frame 9 extending around the entire pallet bottom 5*a*.

Metal pallet 1 and pallet feet 8 are realized in the form of one single structural component. For this purpose, metal pallet 1, with stiffening formations 6, molded-in support foot 7 and molded-on pallet feet 8 has been manufactured in the course of a drawing/pressure forming and a bending process from a precut metal plate. The precut metal plate may be a steel sheet plate with ear-like metal attachments located in the corner areas. The drawing/pressure shaping process is substantially a deep-drawing process. Pallet feet 8 are produced from the metal attachments in the course of the bending off and re-bending process and extend below pallet bottom 5*a*. Furthermore, the edges of pallet feet 8 are welded to pallet bottom 5*a*. In the back of metal pallet 1, an additional support foot 10 is molded in. Drain gutter 11 is molded into metal pallet 1, extending from additional support foot 10 in the back to support foot 7 on the front-side with a predetermined inclination.

Stiffening traverse member 12 is arranged on the pallet bottom 5*a*, extending in an orthogonal configuration in relation to drain gutter 11, from one broad side to the other broad side of pallet bottom 5*a*. Stiffening traverse member 12 is connected on the ends with secondary support feet 13 of metal pallet 1.

Figure 6:
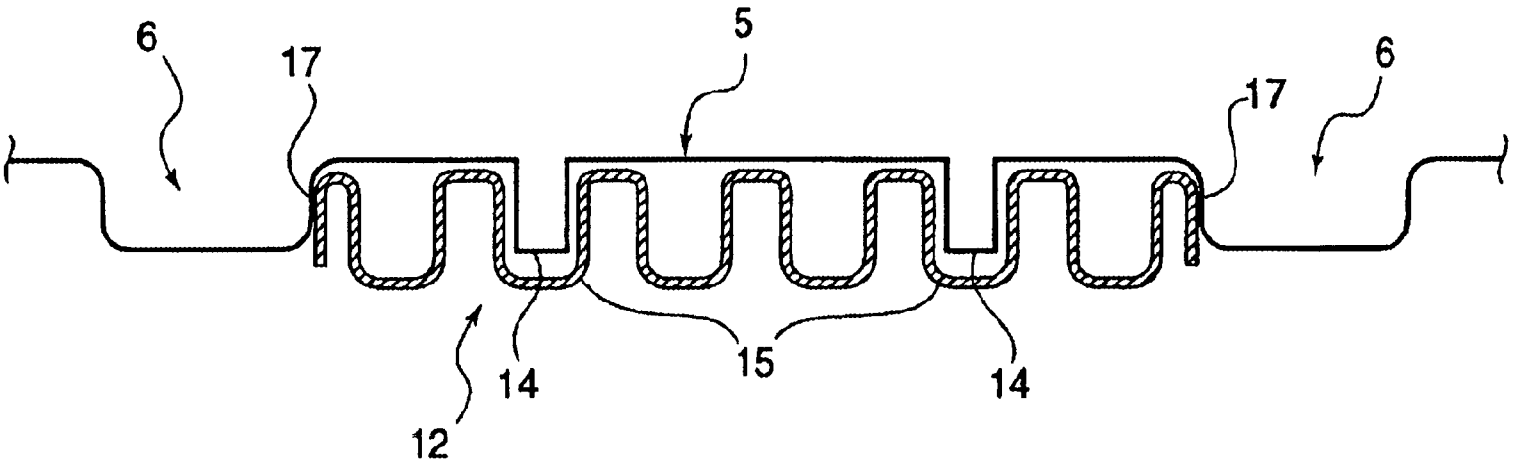
FIG. 6 is a vertical section B—B through the object according to FIG. 3.

FIG. 6 shows stiffening traverse member 12 is embodied in the form of a multi-gutter section comprising U-profiles with alternating cross sections. Pallet bottom 5*a* has U-shaped, inward moldings 14 that engage the grooves or U-profiles of stiffening traverse member 12. The grooves or U-profiles 15 are open on their top sides. According to the exemplified embodiment comprising secondary support feet 13 molded onto the broad sides of metal pallet 1 and produced in the course of the reforming bending process, stiffening traverse member 12 is welded in between secondary support feet 13 and the pallet bottom 5*a*.

Stiffening beads or formations 6 which form depressions, located in metal pallet 1 are in the form of rectangles which are distributed across the surface area of metal pallet 1 in an axially or mirror symmetrical arrangement on both sides of drain gutter 11. Rectangular stiffening formations 6 may comprise diagonal beads 16. Stiffening traverse member 12 is centered between associated flanks 17 of rectangular stiffening formations 6, bulging outwards from the pallet bottom 5*a*.

Figure 7:
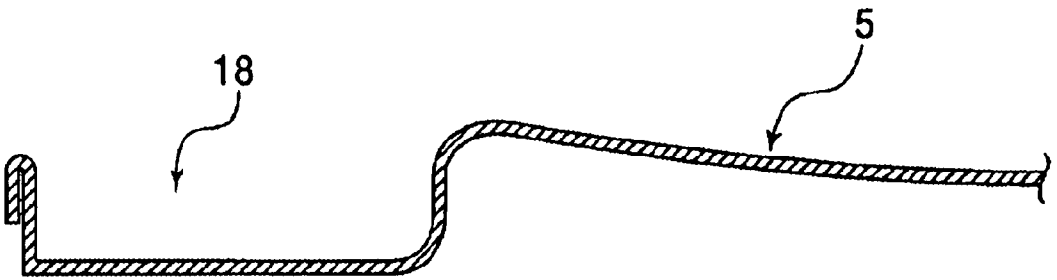
FIG. 7 is a vertical section C—C through the object according to FIG. 2.

FIGS. 4, 5 and 7 show metal pallet 1 may comprise a dish-like receptacle for receiving plastic container 2*a* with adaptation to the bottom of the container, and furthermore comprises installation groove 18 on the peripheral side for mounting and connecting wire grating jacket 2*b*. In addition to clip fastening 19 of FIG. 8, securing wire grating jacket 2*b* by welding or screwing is conceivable as well. Furthermore, pallet bottom 5*a* with stiffening frame 9 comprises slide-in openings 20 located between pallet feet 8 and the respective support feet (molded-in support foot 7, additional support foot 10, and secondary support feet 13) for receiving fork-lift trucks or the like hoisting gear.

Accordingly, while only a few embodiments of the present invention have been shown and described, it is obvious that many changes and modifications may be made thereunto without departing from the spirit and scope of the invention.

What is claimed is:

1. A metal pallet for receiving and securing a container, said metal pallet having a front, back, top and bottom, and comprising:

a molded in support foot on the front-side of the metal pallet and open along the front side of the metal pallet, wherein said molded-in support foot receives an emptying device for draining the container;

pallet feet arranged in corner areas of the metal pallet and integrally formed with the metal pallet as a one piece structural unit, wherein the metal pallet is produced from a precut metal plate by a drawing/pressure shaping process and a reshaping bending process with ear-like metal attachments located in the corner areas of said pre-cut metal plate;

stiffening formations disposed in the metal pallet; and a stiffening frame connecting each of said pallet feet.

2. The metal pallet according to claim 1, wherein said pallet feet are produced from said ear-like metal attachments in the course of said reshaping bending process of the metal pallet, and wherein said pallet feet extend under said bottom of the metal pallet.

3. The metal pallet according to claim 1, wherein said pallet feet are connected to the metal pallet at edges of said pallet feet and said bottom of the metal pallet, by welding or clamping.

4. The metal pallet according to claim 1, wherein an additional support foot is molded-in in said back of the metal pallet from a metal attachment in the course of said reshaping bending process.

5. The metal pallet according to claim 4, wherein a drain gutter is molded into the metal pallet, extending with a a predetermined inclination from said additional support foot located on said back of the metal pallet to said molded-in support foot located on said front of the metal pallet.

6. The metal pallet according to claim 5, wherein a stiffening traverse member is arranged on said bottom of the metal pallet, said stiffening traverse member extending in an orthogonal manner in relation to said drain gutter from one broad side to another broad side of said bottom of the metal pallet, and comprises secondary support feet on the end side, or is connected with secondary support feet of the metal pallet.

7. The metal pallet according to claim 6, wherein said stiffening traverse member is a multi-groove section comprising in its cross section one of a meander-shaped profile and alternating U-profiles.

8. The metal pallet according to claim 6, wherein said bottom of the metal pallet comprises inward moldings engaging grooves or U-profiles of said stiffening traverse member, said grooves or U-profiles being open at the top.

9. The metal pallet according to claim 6, wherein said stiffening traverse member with said secondary support feet is joined with said bottom of the metal pallet in an area of said secondary support feet by welding or clamping.

10. The metal pallet according to claim 6, wherein said secondary support feet are molded onto the broad sides of the metal pallet and produce during said reshaping bending process and said stiffening traverse member is welded or clamped in between said secondary support feet and said bottom of the metal pallet.

11. The metal pallet according to claim 6, wherein said stiffening formations in the metal pallet are selected from the group consisting of rectangles, squares and circles.

12. The metal pallet according to claim 11, wherein said stiffening formations are distributed across the surface area of the metal pallet in an axially symmetrical or mirror-symmetrical arrangement on both sides of said drain gutter.

13. The metal pallet according to claim 11, wherein said stiffening formations comprise diagonal beads or radial beads.

14. The metal pallet according to claim 11, wherein said stiffening traverse member is centered between associated flanks of said stiffening formations bulging outwards from said bottom of the metal pallet.

15. The metal pallet according to claim 6, wherein said bottom of the metal pallet with said stiffening frame comprises slide-in openings located between one of said pallet feet and one of the support feet for being engaged by fork-lift trucks and similar hoisting gear.

16. The metal pallet according to claim 6, wherein said stiffening frame is recessed between said pallet feet and said support feet against said bottom of the metal pallet.

17. The metal pallet according to claim 1, wherein the metal pallet comprises a dish-like receptacle for receiving the container with adaptation to the bottom of the container.

18. The metal pallet according to claim 1, wherein the metal pallet has an installation groove on a peripheral side for mounting and connecting a wire grating jacket surrounding the container.

19. A metal pallet for receiving and securing a container, said metal pallet having a trout, back, top and bottom, and comprising:

a molded in support foot on the front-side of the metal pallet and open along the front side of the metal pallet, wherein said molded-in support foot receives an emptying device for draining the container;

pallet feet arranged in corner areas of the metal pallet and integrally formed with the metal pallet as a one piece structural unit, wherein the metal pallet is produced from a precut metal plate by a drawing/pressure shaping process and a reshaping bending process with ear-like metal attachments located in the corner areas of said pre-cut metal plate;

stiffening formations disposed in the metal pallet;

a stiffening frame connecting each of said pallet feet;

an additional support foot molded in in said back of the metal pallet from metal attachment in the course of said reshaping bending process; and a drain gutter molded into the metal pallet, extending with a predetermined inclination from said additional support foot located on said back of the metal pallet to said molded-in support foot located on said front of the metal pallet.

* * * * *